US007020386B2

(12) United States Patent
Scime et al.

(10) Patent No.: US 7,020,386 B2
(45) Date of Patent: Mar. 28, 2006

(54) RECREATIONAL VEHICLE WATER HEATER

(75) Inventors: John M. Scime, Granger, IN (US); John M Kloster, Granger, IN (US)

(73) Assignee: Atwood Mobile Products, Inc., Elkhart, IN (US)

( * ) Notice: Subject to any disclaimer, the term of this patent is extended or adjusted under 35 U.S.C. 154(b) by 0 days.

(21) Appl. No.: 10/901,899

(22) Filed: Jul. 29, 2004

(65) Prior Publication Data

US 2006/0024036 A1 Feb. 2, 2006

(51) Int. Cl.
*F28D 7/00* (2006.01)

(52) U.S. Cl. ..... 392/441; 392/449

(58) Field of Classification Search ..... 392/441, 392/449

See application file for complete search history.

(56) References Cited

U.S. PATENT DOCUMENTS 5,347,956 A 9/1994 Hughes
5,588,088 A * 12/1996 Flaman ..... 392/449
6,275,655 B1 * 8/2001 Rixen ..... 392/496

* cited by examiner

*Primary Examiner*—Thor S. Campbell

(74) *Attorney, Agent, or Firm*—Banner & Witcoff Ltd.; Peter D. McDermott; Dean B. Watson

(57) ABSTRACT

A recreational vehicle water heater includes a tank for holding water to be heated and a heating element to heat the water in the tank. The tank has an inlet port and an outlet port. A cold water supply conduit is in fluid communication with the inlet port. A mixing valve has a first inlet port, a second inlet port, and an outlet port. The outlet port on the tank is in fluid communication with the first inlet port of the mixing valve. A cold water mixing conduit is in fluid communication with the second inlet port of the mixing valve. The mixing valve is configured to regulate a flow of heated water through the outlet port on the tank and a flow of cold water through the second inlet port of the mixing valve to output a flow of water at a desired temperature through the outlet port of the mixing valve.

23 Claims, 2 Drawing Sheets

RECREATIONAL VEHICLE WATER HEATER

FIELD OF THE INVENTION

This invention relates generally to a water heater for a recreational vehicle and, in particular, to a water heater for a recreational vehicle having improved performance.

BACKGROUND OF THE INVENTION

Motor vehicle manufacturers are necessarily concerned with saving space and reducing weight when designing and fabricating a recreational vehicle ("RV"). Maintaining designed operating conditions and performance levels are also important. When designing and constructing a water heater for an RV, these considerations present a challenge. A water heater in an RV typically holds no more than about 10 gallons in order to conserve space and weight. The output temperature of the water heater is typically controlled to be no higher than approximately 130° F. to prevent scalding by users at the fixtures located in the RV. To produce more hot water for the users of the RV, it has been known to increase the size of the water heater tank to approximately 12 gallons. Although a larger tank provides a greater amount of heated water, it creates both space and weight issues as compared to the typical 10 gallon water heater tank.

There is also a need for users to winterize their RV in cold climates. Users often add a bypass kit that enables the introduction of antifreeze into the RV water distribution system without the need to supply the tank itself with antifreeze.

It is an object of the present invention to provide a water heater for an RV with an increased heated water output, while reducing or overcoming some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a recreational vehicle water heater with improved hot water production. In accordance with a first preferred embodiment, a recreational vehicle water heater includes a tank for holding water to be heated and a heating element to heat the water in the tank. The tank has an inlet port and an outlet port. A cold water supply conduit is connected to the inlet port. A mixing valve has a first inlet port, a second inlet port, and an outlet port. The outlet port on the tank is connected the first inlet port of the mixing valve. A cold water mixing conduit is connected to the second inlet port of the mixing valve. The mixing valve is configured to regulate a flow of heated water through the outlet port on the tank and a flow of cold water through the second inlet port of the mixing valve to output a flow of water through the outlet port of the mixing valve having a desired temperature.

In accordance with another preferred embodiment, a recreational vehicle water heater includes a tank for holding water to be heated and a heating element to heat water in the tank. A thermostat is connected to the heating element. The tank has an inlet port and an outlet port. A cold water supply conduit is connected to the inlet port. A mixing valve has a first inlet port, a second inlet port, and an outlet port. The outlet port on the tank is in fluid communication with the first inlet port of the mixing valve. The cold water supply conduit is in fluid communication with the second inlet port of the mixing valve. The mixing valve is configured to regulate a flow of heated water through the first inlet port of the mixing valve and a flow of cold water through the second inlet port of the mixing valve to output a flow of water at a desired temperature through the outlet port.

In accordance with a further embodiment, a water heater for a recreational vehicle includes a housing and a tank positioned in the housing for holding water to be heated. Insulation is positioned between an exterior of the tank and an interior of the housing. A heating element is positioned in the tank. A thermostat is connected to the heating element. The tank has an inlet port and an outlet port. A cold water supply conduit is connected to the inlet port. A mixing valve has a first inlet port, a second inlet port, and an outlet port. The outlet port on the tank is in fluid communication with the first inlet port. The second inlet port is in fluid communication with the cold water supply conduit. The mixing valve is configured to regulate a flow of heated water through the first outlet port and a flow of cold water through the second inlet port to output a flow of water at a desired temperature through the outlet port.

In accordance with yet another embodiment, a water heater for a recreational vehicle includes a housing and a tank positioned in the housing for holding water to be heated. Insulation is positioned between an exterior of the tank and an interior of the housing. A heating element is positioned in the tank. A thermostat is connected to the heating element. The tank has an inlet port and an outlet port. A cold water supply conduit is connected to the inlet port. A mixing valve has a first inlet port, a second inlet port, and an outlet port. The outlet port is in fluid communication with the first inlet port. The second inlet port is in fluid communication with the cold water supply conduit. The mixing valve is configured to regulate a flow of heated water through the first outlet port and a flow of cold water through the second inlet port to output a flow of water at a desired temperature through the outlet port. A bypass valve has an inlet in fluid communication with the cold water supply conduit, a first outlet in fluid communication with the inlet port of the tank; and a second outlet in fluid communication with the outlet port of the mixing valve.

Substantial advantage is achieved by providing recreational vehicle water heater in accordance with preferred embodiments of the present invention. In particular, certain preferred embodiments of the present invention provide a greater output of heated water for a tank of a given size, while at the same time ensuring that the output water is at a desired and safe temperature and allowing a user to bypass the water heater tank to winterize the system.

These and additional features and advantages of the invention disclosed here will be further understood from the following detailed disclosure of certain preferred embodiments.

Figure 1:
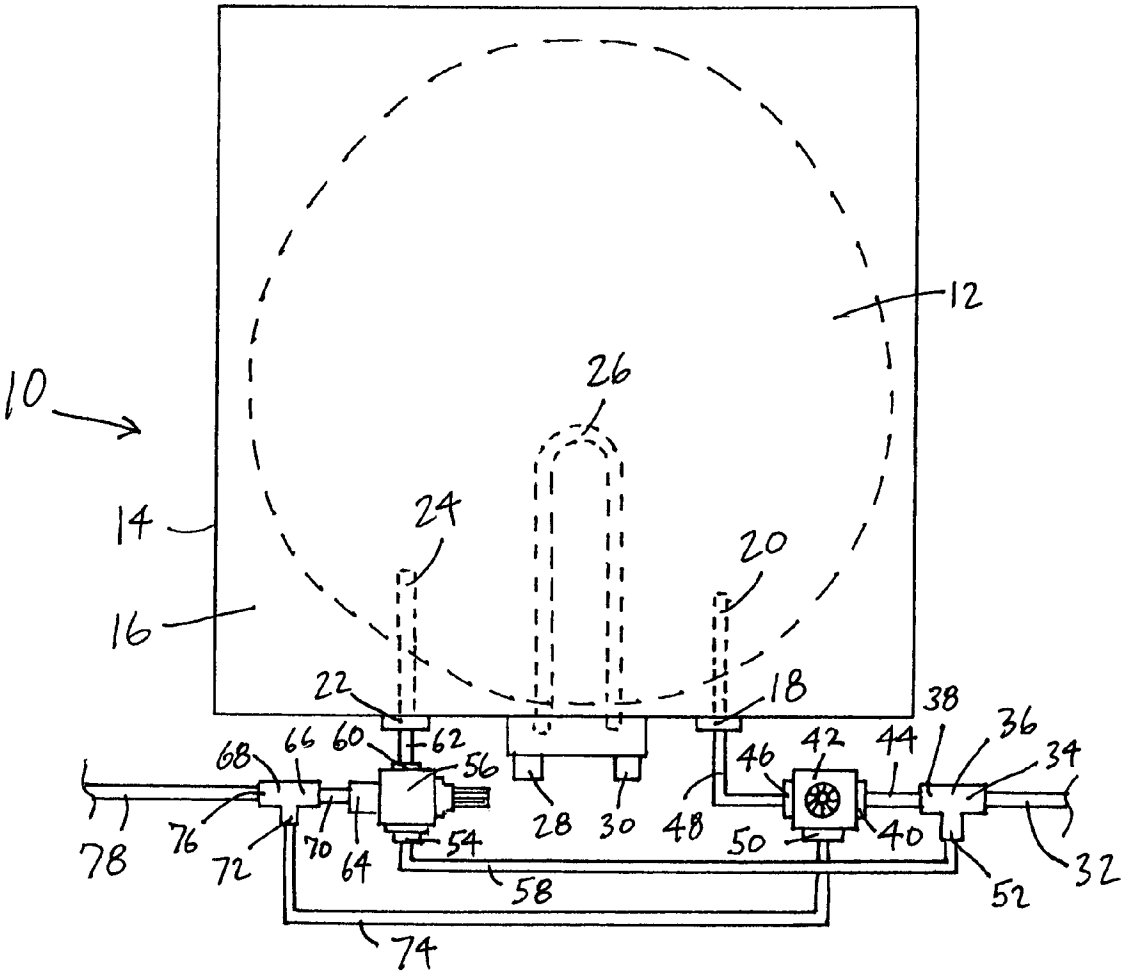
FIG. 1 is a plan view of a water heater for a recreational vehicle in accordance with a preferred embodiment of the present invention.

The figures referred to above are not drawn necessarily to scale and should be understood to provide a representation of the invention, illustrative of the principles involved. Some features of the recreational vehicle water heater depicted in the drawings have been enlarged or distorted relative to others to facilitate explanation and understanding. The same reference numbers are used in the drawings for similar or identical components and features shown in various alternative embodiments. Recreational vehicle water heaters as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of a water heater 10 is shown in FIG. 1. Water heater 10 includes a tank 12 positioned in a housing 14. Insulation 16 is positioned between the exterior of tank 12 and housing 14 to retain the heat generated by water heater 10. Insulation 16 is formed of styrofoam or other suitable insulating material. Tank 12 has an inlet port 18 for supplying cold water. Inlet port 18 may include a conduit 20 extending into tank 12. An outlet port 22 allows heated water to pass out of tank 12. Outlet port 22 may include a conduit 24 extending into tank 12. Conduit 24, and other conduits described herein, may be any suitable length of pipe or tubing, such as copper piping, flexible tubing, etc. and including any necessary elbows, couplings or other fittings. Suitable conduit materials will become readily apparent to those skilled in the art, given the benefit of this disclosure.

Figure 2:
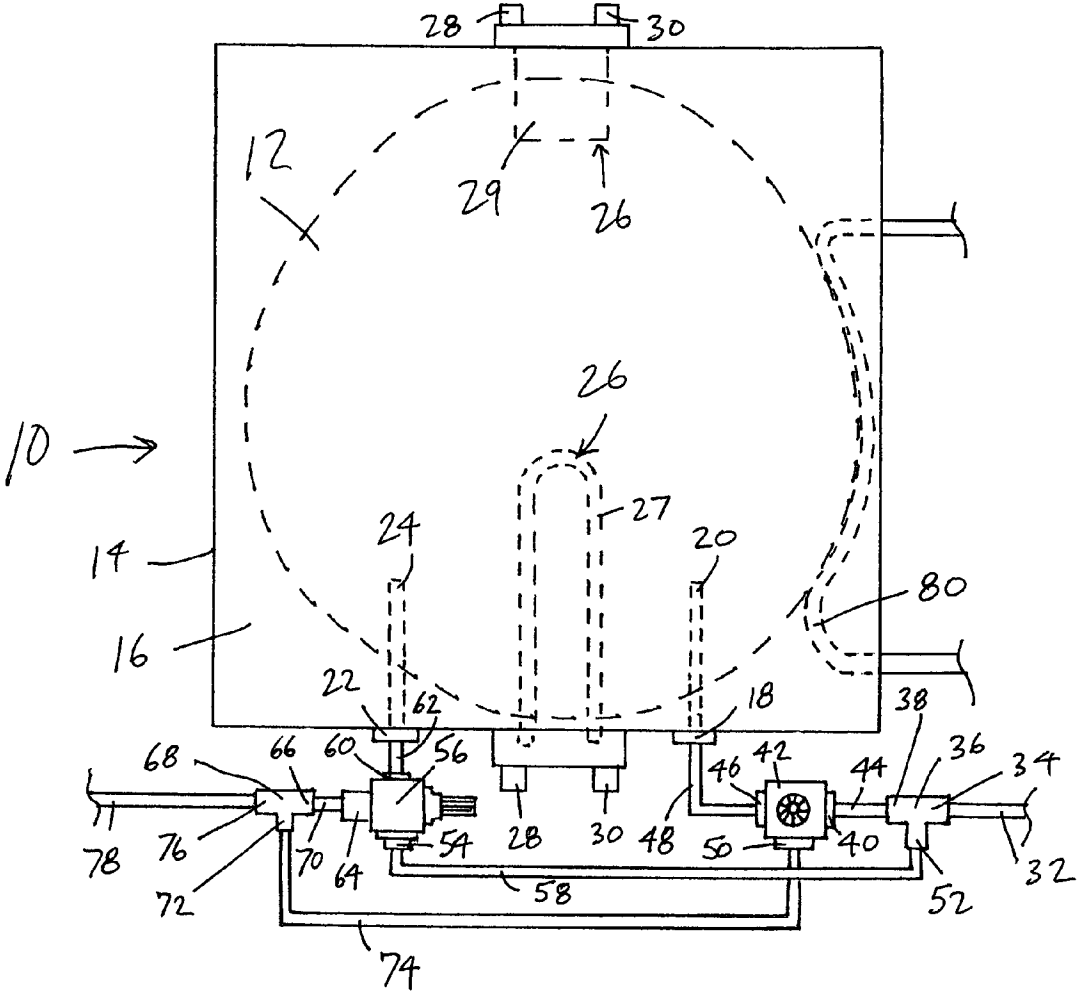
FIG. 2 is a plan view of a water heater for a recreational vehicle in accordance with an alternative embodiment of the present invention.

A heating device 26 is provided in tank 12 and serves to heat the cold water entering tank 12. Heating device 26 may be an electric heating element 27 (as seen in FIG. 1), or a gas-fired heating element 29 (as seen in FIG. 2). In certain preferred embodiments, heating device 26 may include both an electric heating element 27 and a gas-fired heating element 29, as illustrated in FIG. 2. Thus, when the RV is hooked up to a power source, the electric heating element 27 can be used. The gas-fired element 29 can be used when power is not available. In such an embodiment, both the electric heating element 27 and the gas-fired heating element 29 can be used simultaneously when electric power is available in order to heat the water more quickly.

A thermostat 28 is operably connected to heating device 26 and serves to control the operation of heating device 26 to heat the cold water to a desired temperature. In a preferred embodiment, thermostat 28 is set to heat the water to a temperature of approximately 160° F. in tank 12. In certain preferred embodiments, an energy cut-off, or safety switch 30 is connected to heating device 26, and serves to shut off heating device 26 in the event that thermostat 28 malfunctions and the water is heated beyond the setpoint temperature of the thermostat. In a preferred embodiment, safety switch 30 is configured to power off heating device 26 when the water in the tank reaches approximately 185–190° F.

A cold water supply line 32 is connected to a source of cold water (not shown here). The cold water may enter tank 12 at a temperature between approximately 40° F. and 85° F. Cold water supply line 32 is connected to a first leg 34 of a first tee 36. A second leg 38 of first tee 36 is connected to an inlet 40 of a bypass valve 42. Second leg 38 may be directly connected to inlet 40 or, as illustrated here, by a conduit 44. A first outlet 46 of bypass valve 42 is connected to inlet port 18 of tank 12 either directly or, as illustrated here, by a conduit 48.

In a normal operating condition, cold water flows from supply line 32, through tee 36 and conduit 44, and through bypass valve 42 and conduit 48 into inlet port 18 of tank 12, thereby providing a supply of cold water to be heated. In a bypass mode, bypass valve 42 directs the cold water entering inlet 40 out through a second outlet 50 of bypass valve 42 to the water distribution system of the RV, as described in greater detail below, such that no cold water enters tank 12. This is especially advantageous when the RV is being winterized, and allows antifreeze to be provided in the various lines, conduits and valves of the water distribution system of the RV without the need to put antifreeze in tank 12. Tank 12 can simply be drained to prevent any freezing problems.

A second outlet 52 of first tee 36 is connected to a first inlet 54 of a mixing valve 56 to supply cold water to mixing valve 56. In the illustrated embodiment, second outlet 52 of first tee 36 is connected to first inlet 54 by way of a conduit 58. Outlet port 22 of tank 12 is connected to a second inlet 60 of mixing valve 56 to supply heated water to mixing valve 56. Outlet port 22 may be directly connected to second inlet 60 or, as illustrated here, connected by way of conduit 62. An outlet 64 of mixing valve 56 supplies water at a desired temperature to the users of the RV. In a preferred embodiment, first inlet 54 and second inlet 60 of mixing valve 56 include check valves to prevent antifreeze and/or other contaminants from entering tank 12 and the water supply.

Outlet 64 of mixing valve 56 is connected to a first leg 66 of a second tee 68. Outlet 64 may be directly connected to first leg 66 or, as illustrated here, by a conduit 70. Second outlet 50 of bypass valve 42 is connected to a second leg 72 of second tee 68 either directly or by way of a cold water bypass line 74 as illustrated here. A third leg 76 of second tee 68 is connected to an outlet supply line 78, which is connected to the hot water distribution system of the RV (not shown), providing heated water to the sink(s), shower and other plumbing fixtures in the RV that use heated water.

In a normal operating condition of water heater 10, heating device 26 heats the water supplied to tank 12 to a temperature higher than that safely allowed for domestic use. In a preferred embodiment, the water in tank 12 is heated to approximately 160° F. This heated water exits tank 12 at outlet 22 and is mixed with cold water in mixing valve 56 and exits through outlet 64, conduit 70, second tee 68 and outlet supply line 78 to the hot water distribution system of the RV. In the bypass mode described above, the cold water diverted through second outlet 50 of bypass valve 42 passes through cold water bypass line 74, second tee 68 and outlet supply line 78 to the hot water distribution system of the RV.

In the event that not enough cold water is being supplied to mixing valve 56 through conduit 58 such that mixing valve 56 cannot maintain the desired output temperature, mixing valve 56 will close off flow to outlet 64 to prevent the flow of excessively hot water to the user.

An additional, or alternative, heating device such as heating element 80, as illustrated in FIG. 2, may be provided for water heater 10. Heating element 80 comprises a conduit that is in contact with the side of tank 12 and which carries heated coolant from the engine of the RV. The heat from the coolant is transferred by conduction through the walls of conduit 80 and tank 12. This embodiment is especially energy efficient since no power is needed to heat the water. Heating element 80 may be used alone or in combination with the electric and/or gas-fired heating device 26.

By providing mixing valve 56, water heater 10 can heat water beyond the desired output temperature (typically 130°

F.), which heated water is then mixed with cold water to produce a greater amount of water at the desired output temperature without increasing the size of tank 12. Thus, improved performance and hot water output is realized without a corresponding increase in space requirements or weight, which would be seen with a larger tank. In certain embodiments, mixing valve 56 may be sealed and capped once it has been set to the desired output temperature, such that it cannot be tampered with without an obvious break of the seal. This will help prevent inadvertent altering of the temperature setting of mixing valve 56 and reduce the chance of a user coming into contact with water that is too hot.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A water heater for a recreational vehicle comprising, in combination:

a tank for holding water to be heated;

a heating device to heat water in the tank;

an inlet port on the tank;

an outlet port on the tank;

a cold water supply conduit in fluid communication with the inlet port;

a mixing valve having a first inlet port, a second inlet port, and an outlet port, the outlet port on the tank in fluid communication with the first inlet port of the mixing valve, the cold water supply conduit in fluid communication with the second inlet port of the mixing valve, the mixing valve configured to regulate a flow of heated water through the first inlet port of the mixing valve and a flow of cold water through the second inlet port of the mixing valve to output a flow of water at a desired temperature through the outlet port of the mixing valve; and a bypass valve having an inlet in fluid communication with the cold water supply conduit, a first outlet in fluid communication with the inlet port of the tank, and a second outlet.

2. The water heater of claim 1, wherein the mixing valve is configured to regulate the flow of heated water and the flow of cold water such that the flow of water through the outlet port of the mixing valve is at approximately 130° F.

3. The water heater of claim 1, further comprising a thermostat connected to the heating device.

4. The water heater of claim 3, wherein the thermostat is set to a temperature of approximately 160° F.

5. The water heater of claim 3, further comprising a safety switch to power off the heating device when a setpoint temperature in the tank is reached.

6. The water heater of claim 5, wherein the setpoint temperature is approximately 185–190° F.

7. The water heater of claim 1, wherein the heating device is electric.

8. The water heater of claim 1, wherein the heating device is gas-fired.

9. The water heater of claim 1, wherein the heating device is configured to be gas-fired and powered by electricity.

10. The water heater of claim 1, further comprising an additional heating device, the additional heating device comprising a conduit in contact with an exterior of the tank and configured to receive heated coolant from the recreational vehicle.

11. The water heater of claim 1, wherein the mixing valve includes a check valve to prevent a flow of water into the outlet port of the tank.

12. A recreational vehicle water heater comprising, in combination:

a tank for holding water to be heated;

a heating device to heat water in the tank;

a thermostat operably connected to the heating device;

an inlet port on the tank;

an outlet port on the tank;

a cold water supply conduit connected to the inlet port;

a mixing valve having a first inlet port, a second inlet port, and an outlet port, the outlet port on the tank in fluid communication with the first inlet port of the mixing valve, the cold water supply conduit in fluid communication with the second inlet port of the mixing valve, the mixing valve configured to regulate a flow of heated water through the first inlet port of the mixing valve and a flow of cold water through the second inlet port of the mixing valve to output a flow of water at a desired temperature through the outlet port; and a bypass valve having an inlet in fluid communication with the cold water supply conduit, a first outlet in fluid communication with the inlet port of the tank, and a second outlet.

13. The water heater of claim 12, further comprising a safety switch to power off the heating device when a setpoint temperature in the tank is reached.

14. A water heater for a recreational vehicle comprising, in combination:

a housing;

a tank positioned in the housing for holding water to be heated;

insulation positioned between an exterior of the tank and an interior of the housing;

a heating device positioned in the tank;

a thermostat operably connected to the heating device;

an inlet port on the tank;

an outlet port on the tank;

a cold water supply conduit connected to the inlet port;

a mixing valve having a first inlet port, a second inlet port, and an outlet port, the outlet port on the tank in fluid communication with the first inlet port, the second inlet port in fluid communication with the cold water supply conduit, the mixing valve configured to regulate a flow of heated water through the first outlet port and a flow of cold water through the second inlet port to output a flow of water at a desired temperature through the outlet port; and a bypass valve having an inlet in fluid communication with the cold water supply conduit; a first outlet in fluid communication with the inlet port of the tank; and a second outlet.

15. A water heater for a recreational vehicle comprising, in combination:

a housing;

a tank positioned in the housing for holding water to be heated;

insulation positioned between an exterior of the tank and an interior of the housing;

a heating device positioned in the tank;

a thermostat operably connected to the heating device;

an inlet port on the tank;

an outlet port on the tank;

a cold water supply conduit connected to the inlet port; and a mixing valve having a first inlet port, a second inlet port, and an outlet port, the outlet port on the tank in fluid communication with the first inlet port, the second inlet port in fluid communication with the cold water supply conduit, the mixing valve configured to regulate a flow of heated water through the first outlet port and a flow of cold water through the second inlet port to output a flow of water at a desired temperature through the outlet port; and a bypass valve having an inlet in fluid communication with the cold water supply conduit; a first outlet in fluid communication with the inlet port of the tank; and a second outlet in fluid communication with the outlet port of the mixing valve.

16. The water heater of claim 15, wherein the mixing valve is configured to regulate the flow of heated water and the flow of cold water such that the flow of water through the outlet port of the mixing valve is at approximately 130° F.

17. The water heater of claim 15, wherein the thermostat is set to a temperature of approximately 160° F.

18. The water heater of claim 15, further comprising a safety switch to power off the heating device when a setpoint temperature in the tank is reached.

19. The water heater of claim 18, wherein the setpoint temperature is approximately 185–190° F.

20. The water heater of claim 15, wherein the heating device is electric.

21. The water heater of claim 15, wherein the heating device is gas-fired.

22. The water heater of claim 15, wherein the heating device is configured to be gas-fired and powered by electricity.

23. The water heater of claim 15, further comprising an additional heating device, the additional heating device comprising a conduit in contact with an exterior of the tank and configured to receive heated coolant from the recreational vehicle.

* * * * *